US007466242B2

(12) United States Patent
Berman

(10) Patent No.: US 7,466,242 B2
(45) Date of Patent: Dec. 16, 2008

(54) METHOD AND SYSTEM FOR CHARGING A VEHICLE FOR PARKING

(75) Inventor: Anna Berman, P.O. Box 3773, Beer Sheva (IL)

(73) Assignees: Anna Berman, Beer Sheva (IL); Reuben Berman, Beer Sheva (IL)

( * ) Notice: Subject to any disclaimer, the term of this patent is extended or adjusted under 35 U.S.C. 154(b) by 128 days.

(21) Appl. No.: 11/381,358

(22) Filed: May 3, 2006

(65) Prior Publication Data

US 2007/0094069 A1 Apr. 26, 2007

(30) Foreign Application Priority Data

May 23, 2005 (IL) ..... 168734

(51) Int. Cl.
*G08G 1/14* (2006.01)

(52) U.S. Cl. ..... 340/932.2

(58) Field of Classification Search ..... 340/932.2, 340/933, 937, 539.1, 870.02; 705/13, 418
See application file for complete search history.

(56) References Cited

U.S. PATENT DOCUMENTS

| | | | | |
|---|---|---|---|---|
| 5,414,624 | A * | 5/1995 | Anthonyson | 701/1 |
| 5,905,247 | A * | 5/1999 | Ilen | 235/384 |
| 6,037,880 | A * | 3/2000 | Manion | 340/932.2 |
| 6,243,029 | B1 * | 6/2001 | Tomer | 340/932.2 |
| 6,885,311 | B2 * | 4/2005 | Howard et al. | 340/932.2 |
| 2004/0039632 | A1 * | 2/2004 | Han et al. | 705/13 |
| 2005/0168352 | A1 * | 8/2005 | Tomer | 340/932.2 |

* cited by examiner

*Primary Examiner*—Phung Nguyen

(57) ABSTRACT

The present invention is directed to a method for charging vehicles for utilizing parking rights in a parking zone and a system thereof. The method comprises the steps of: during a specified time period (e.g. a day, a week, one or more month (s), etc.), intermittently collecting information of utilizing parking rights by vehicles parking in the parking zone and registering the information in a memory (e.g. a database); at the end of the time period, for each of the vehicles, calculating a toll for the utilized parking rights, the calculation based on the information in conjunction with a parking arrangement thereof, and for each of the vehicles charging the calculated toll thereof.

16 Claims, 6 Drawing Sheets

METHOD AND SYSTEM FOR CHARGING A VEHICLE FOR PARKING

FIELD OF THE INVENTION

The present invention relates to the field of charging for vehicle parking.

BACKGROUND OF THE INVENTION

Charging for vehicle parking is a subject that has produced a variety of inventions and innovations. The most well-known inventions in this field are the parking meters in which a user has to insert coins or a credit card in order to obtain "parking rights". Also the parking tickets in which a user has to input the date and time the vehicle proceeds to park are a well-known solution. And recently electronic parking tickets, which are a combination of parking tickets and electronic wallets, have been introduced.

One of the problems of the prior art solutions for charging for parking is the inconvenience caused to the user thereof. At the parking meter machines, the user has to insert coins, which he doesn't carry with him permanently, or a credit card, which also may not be available to the user at the time he wishes to park his vehicle. Moreover, getting parking rights involves the user's activity, whether it is inserting a credit card to the right port of the parking machine, or coins. The parking tickets also cause a great deal of inconvenience, since the user has to input the current date and time. In comparison with these solutions the electronic parking card affords certain relief; however, it is still incumbent upon the user to pre-purchase it, check municipality charges for parking in this zone, etc. In addition, whenever a user parks a vehicle over the allowed time he may have to pay a penalty, which means that he is overcharged for the same service.

In addition to the inconvenience of using the prior art parking methods, there is an additional drawback—from the social aspect. From a civilian's point of view, the abovementioned parking arrangements express a lack of confidence from authorities to the civilian, since in order to enforce the parking rules, the parking authorities (e.g. the municipality) uses inspectors and penalties. This results sometimes with ultimate financial results to the municipality, such as causing damage to public property in revenge.

It is an object of the present invention to provide a method and system for charging for parking, which overcomes the abovementioned drawbacks of the prior art.

It is another object of the present invention to provide a method and system for charging for parking, which is more convenient to the user than the methods used in the prior art.

It is a further object of the present invention to provide a method and system for charging for parking, which enables avoiding penalties.

It is a still further object of the present invention to provide a method and system for charging for parking, which increases the confidence of a user in the authorities, which results in financial benefits (less damage to public property, a better quality of life, etc.)

Other objects and advantages of the invention will become apparent as the description proceeds.

SUMMARY OF THE INVENTION

In one aspect, the present invention is directed to a method for charging vehicles for utilizing parking rights in a parking zone, the method comprising the steps of: during a specified time period (e.g. a day, a week, one or more months, etc.), intermittently collecting information of utilizing parking rights by vehicles parking in the parking zone and registering the information in a memory (e.g. a database); at the end of the time period, for each of which of the vehicles calculating a toll for the utilizing parking rights, the calculation based on the information in conjunction with a parking arrangement thereof, and for each of which of the vehicles charging the calculated toll thereof.

Typically, the information comprises at least an identifier associated with the vehicle (e.g. vehicle's ID, a registration number of the vehicle at a parking authority) and the time the registration is carried out.

According to one embodiment of the invention, collecting the information of utilizing parking rights comprises: photographing a digital image of a vehicle while utilizing parking rights; decoding an identifier of the vehicle from the digital image by OCR means; and optionally, adding additional information by a parking inspector.

According to another embodiment of the invention, obtaining the information for utilizing parking rights is carried out by: transmitting an identifier of a vehicle to a receiving device via communication means; and optionally, adding additional information by a parking inspector.

The parking zone may be a road, a parking yard, or even an entire city.

The parking arrangement may feature a reduced rate for a vehicle of an inhabitant living within the parking zone, a reduced rate for a vehicle parking during certain hours of a day, a reduced rate for a vehicle for which the owner pays a fee for utilizing parking rights in the parking zone, and so forth.

In another aspect, the present invention is directed to a system for charging vehicles for utilizing parking rights in a parking zone, the system comprising: an input mechanism, for intermittently inputting during a time period information of utilizing parking rights in a parking zone by a vehicle; a charge calculator, for calculating a toll according to the information after the time period is over; and a clearance mechanism, for charging the vehicle by the toll.

The input mechanism may be a digital camera, a video camera, a receiver communicating with a transmitter carried by a vehicle and transmitting an identifier associated with the vehicle, and so forth. The input mechanism may further comprise input means, for inputting information by a parking inspector. The information may be stored in a memory such as a database, a file, non-volatile memory, and flash memory, until the toll is calculated

BRIEF DESCRIPTION OF THE DRAWINGS

The present invention may be better understood in conjunction with the following figures.

DETAILED DESCRIPTION OF PREFERRED EMBODIMENTS

The term Parking Time Unit (PTU) refers herein to a time period by which a vehicle is charged by one charging unit for parking in a certain parking zone. For example, in a certain parking zone (e.g. a street, a neighborhood, a city, etc.) a PTU is 1 hour, and the charge thereof (i.e., the charging unit) is $0.5. According to another example, in a certain parking zone a PTU is 24 hours, and the charge thereof is $2.00.

The term Parking Rights refers herein to rights to park a vehicle in a parking zone for a parking time unit. Typically, parking rights are granted upon payment of a fee. The fee may be paid in advance or during the parking, depending on the parking terms conducted at the parking zone. In addition, a user may have to make preliminary arrangements thereof, e.g. to purchase parking tickets, put coins in a slot, etc.

According to the prior art, in order to obtain parking rights in a certain parking zone, a user thereof must pay a fee in advance or during the parking time, which usually causes inconvenience.

Contrary to the prior art, according to the present invention the user does not have to undertake any operation in order to obtain parking rights, but merely parks his vehicle.

Figure 1:
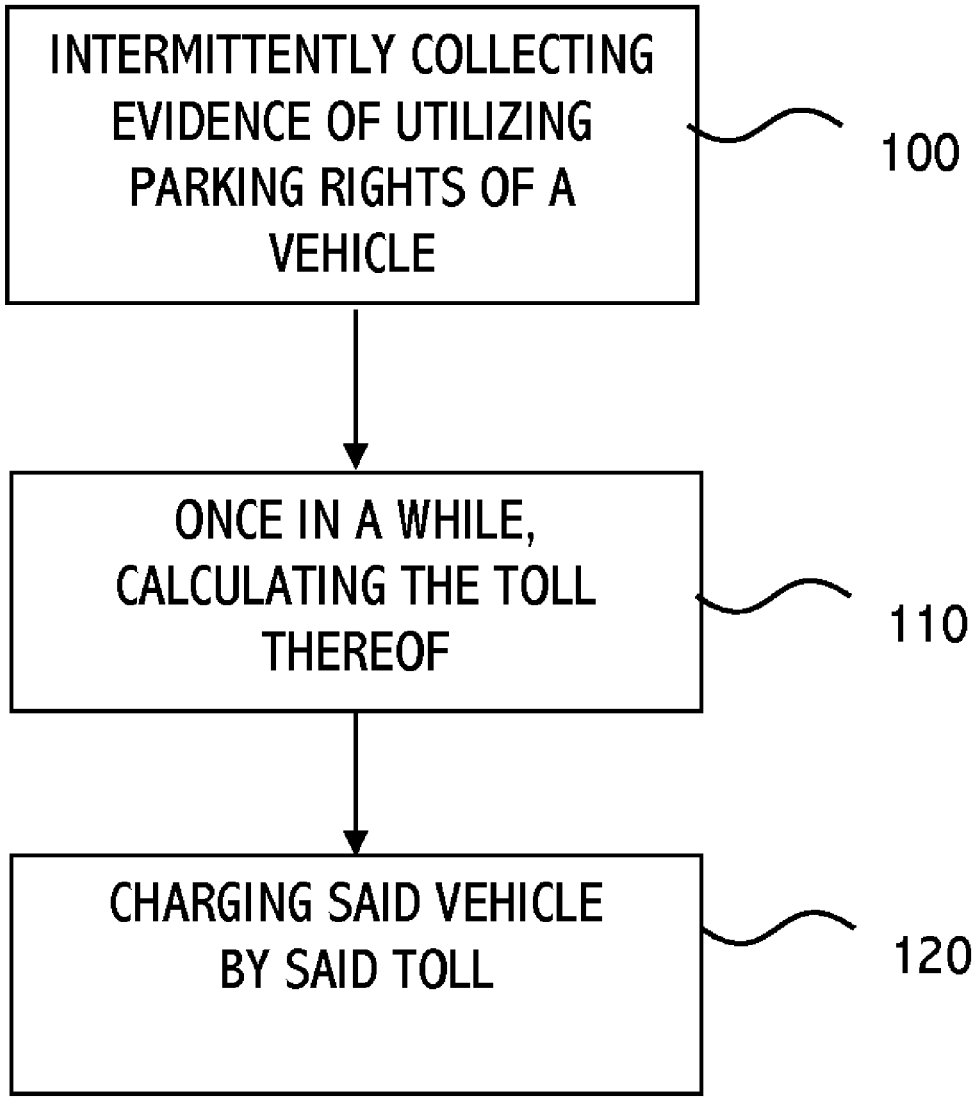
FIG. 1 is a flowchart of a method for charging a vehicle for utilizing parking rights, according to a preferred embodiment of the invention.

FIG. 1 is a flowchart of a method for charging a vehicle for utilizing parking rights, according to a preferred embodiment of the invention.

At block 100, which takes place intermittently (e.g. whenever a parking inspector passes near the parking vehicle) the details of utilizing parking rights by the vehicle are registered by the inspector.

At block 110, which takes place on occasion (e.g. at the end of the day), the toll for utilizing the parking rights is calculated, and the user thereof (e.g. the owner of the vehicle) is charged by the calculated toll (block 120).

Figure 2:
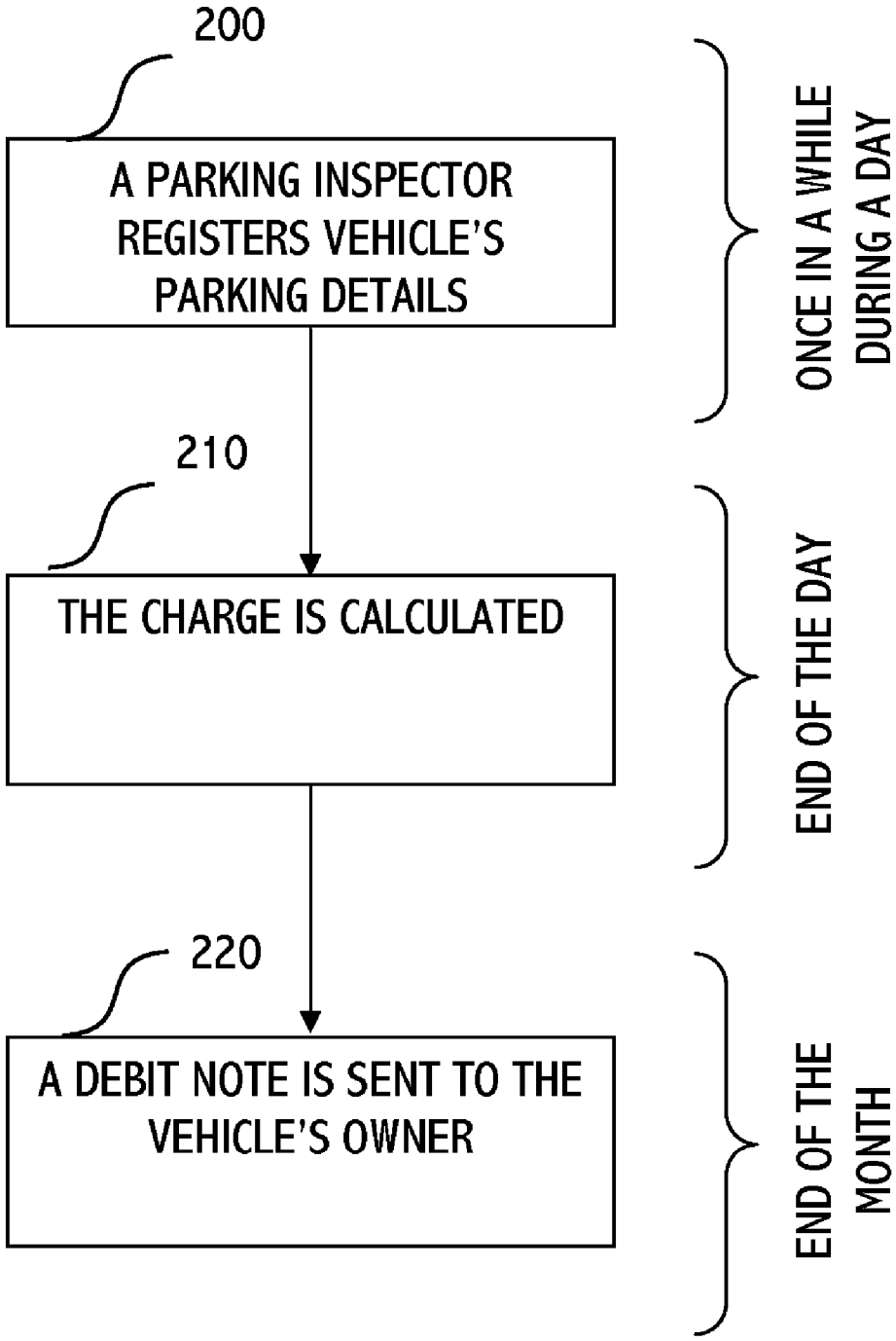
FIG. 2 is a more detailed flowchart of a method for charging a vehicle for utilizing parking rights, according to a preferred embodiment of the invention.

FIG. 2 is a more detailed flowchart of a method for charging a vehicle for utilizing parking rights, according to a preferred embodiment of the invention.

At block 200, which takes place once in a while during the day, a parking inspector registers the vehicle's parking details (for example, the vehicle's ID, place and time of parking). According to a preferred embodiment of the invention the registration is carried out by automatic means, such as a digital camera (video camera, etc.) for obtaining a digital picture of the parking vehicle, and OCR means (usually software) for identifying the vehicle's ID from the digital picture.

At block 210, which takes place at the "end of the day", the toll for utilizing the parking rights is calculated.

At block 220, which takes place at the end of the month, the user (the owner of the vehicle, etc.) is charged for the parking toll, e.g. by a debit note sent to his address, debiting his bank account, etc.

A Generic Example

According to one embodiment of the invention, a parking inspector is equipped with a digital camera which can impress the date, time and text entered by a user (also existing text). According to a preferred embodiment of the present invention, the operations performed by a parking inspector during his daily course are as follows:

Before entering a street, the inspector sets the text to the street name. Then the inspector takes a picture of any parked vehicle in such a way that the vehicle's ID can be identified from the picture.

At the end of the day, for each picture taken throughout the day, the ID and the parking details (e.g. the ID of the vehicle, the street, date and time) of the parking are obtained (usually by OCR means), and the parking toll is calculated according to this information.

At the end of the month, the user (typically the owner of the vehicle) is charged for parking during the month.

The Problematic of Calculating the Toll

Since according to the present invention the presence of a vehicle in a parking zone is obtained intermittently, only partial information of the parking time of a vehicle is available. According to one embodiment of the invention this can be solved by charging for a whole PTU. The fact that a parked vehicle was inspected at a certain time can be used for charging the vehicle for parking at least one PTU.

According to one embodiment of the invention, a PTU is counted from the time a vehicle has been noted as parked. For example, if the vehicle has been inspected as parked at 08:25 AM, then he is charged by one PTU by which he can park without being charged again until 09:24 AM.

According to another embodiment of the invention, a PTU starts at the first minute of an hour, e.g. 10:00, 11:00, 12:00 and so forth.

For example, a vehicle was inspected as parked at 08:15 AM and again at 09:30 AM in the same parking zone. Assuming a PTU is 1 hour, the vehicle has to be charged for two PTUs, since more than one PTU has accumulated between the two inspections. However, if the vehicle was inspected as parked at 08:15 AM and at 08:45 AM, i.e. less than one PTU separating the two inspections, then the vehicle is to be charged by one PTU.

Automatic Method and System for Toll Parking

Since a parking inspector has to inspect a large number of vehicles per day, employing manual methods of inputting parking information, such as typing the ID of a vehicle, is not practical, and therefore more automatic methods should be employed.

Figure 3:
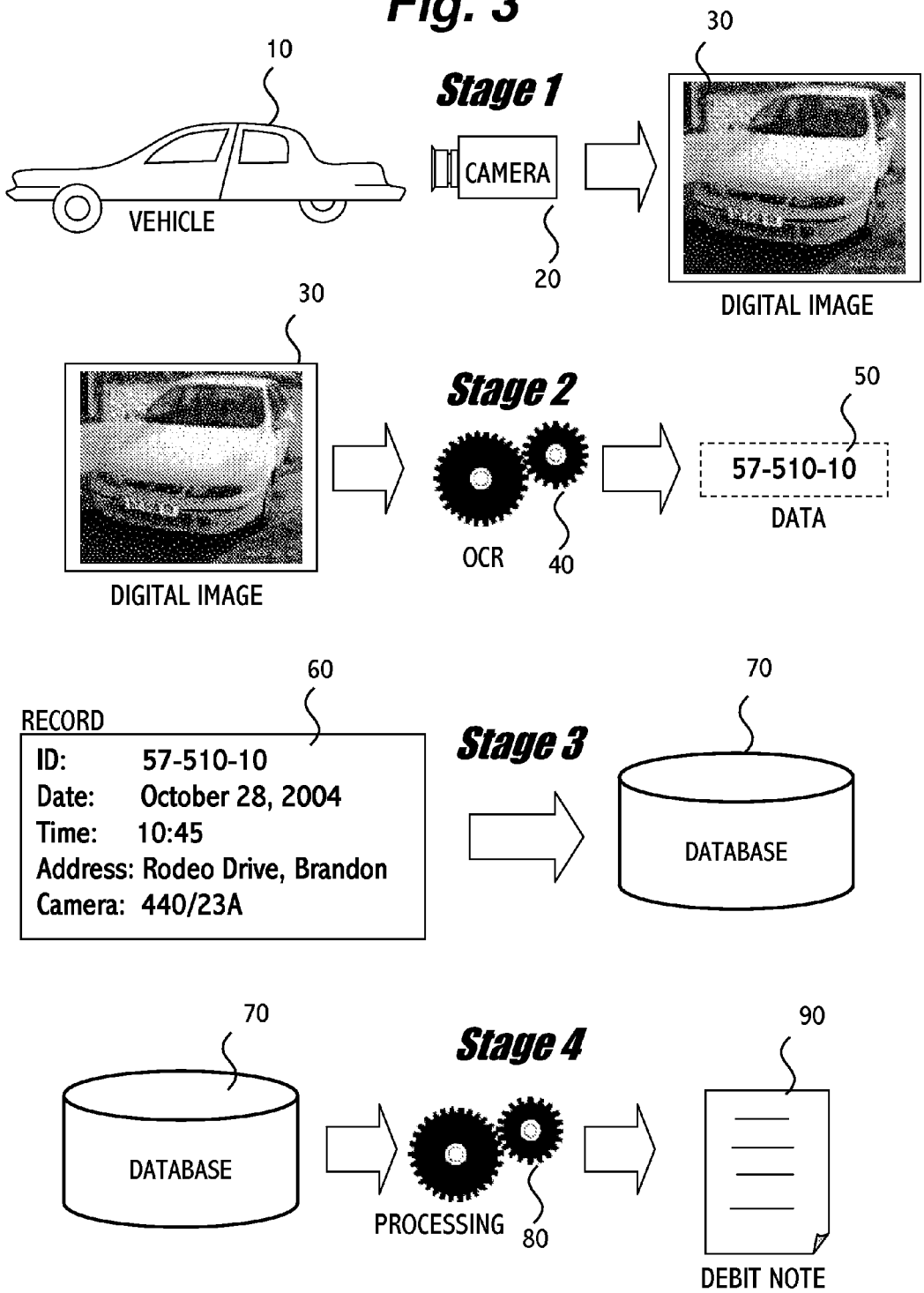
FIG. 3 schematically illustrates a method for charging a vehicle for utilizing parking rights, according to a preferred embodiment of the invention.

FIG. 3 schematically illustrates a method for charging a vehicle for utilizing parking rights, according to a preferred embodiment of the invention.

At stage 1, an inspector employs a digital camera 20 to obtain a digital image 30 of a parking vehicle 10.

At stage 2, the ID 50 of the vehicle is obtained by OCR (Optical Character Recognition) means 40 from the digital image 30. In addition At stage 3, a record 60 is added to a database 70. Typically the record may comprise information about the parking vehicle, such as the vehicle's ID, and information about the parking, e.g. place, date and time.

At step 4, the data stored within the database 70 is employed for calculating the toll for parking by processing means 80 (e.g. a computer), and as a result an invoice 90 is sent to the vehicle's owner.

Means for Identifying a Parking Vehicle

Figure 4:
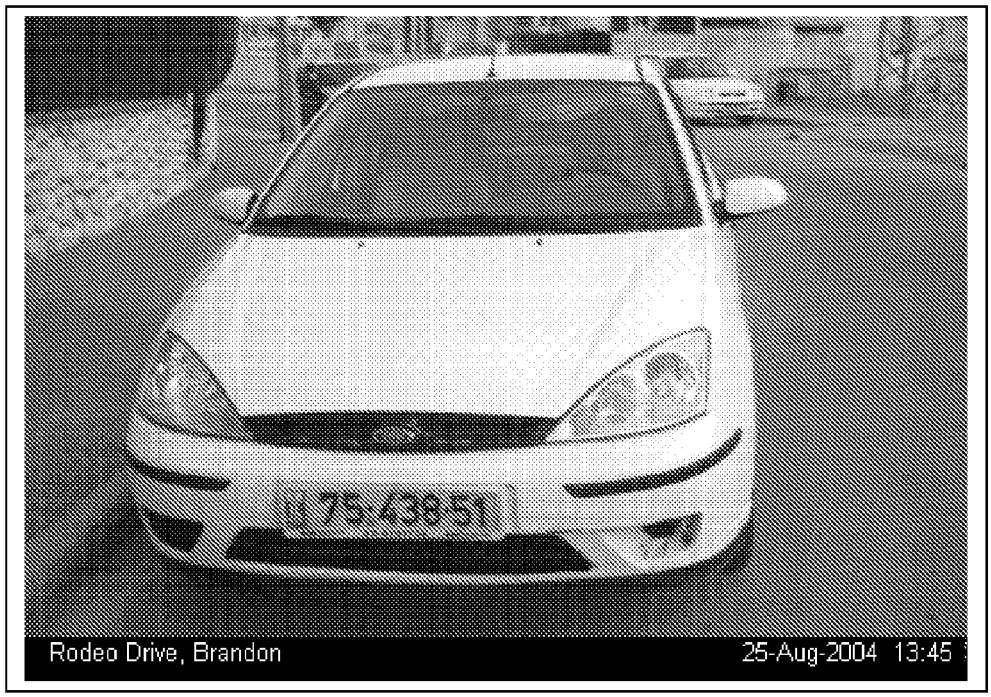
FIG. 4 illustrates a digital picture of a parking vehicle, according to one embodiment of the invention.

FIG. 4 illustrates a digital picture of a parked vehicle, according to one embodiment of the invention. The digital picture comprises the date and time when the picture was taken. In addition, an inspector can add some characters to be impressed on the picture, such as the street. The impressed characters can be identified by OCR (Optical Character Recognition) methods, which nowadays are in common use, and other pattern recognition methods.

The text of date and time are expected to be placed in a certain location on the image, and therefore can easily be identified by OCR method; however, the ID doesn't necessarily be at the same location of the digital picture. Moreover, sometimes a digital image may comprise several regions where digital information can be present, e.g. when the digital picture comprises more than one vehicle, a street sign, etc. Consequently a full automatic system may fail to register a vehicle ID in certain cases.

Figure 5:
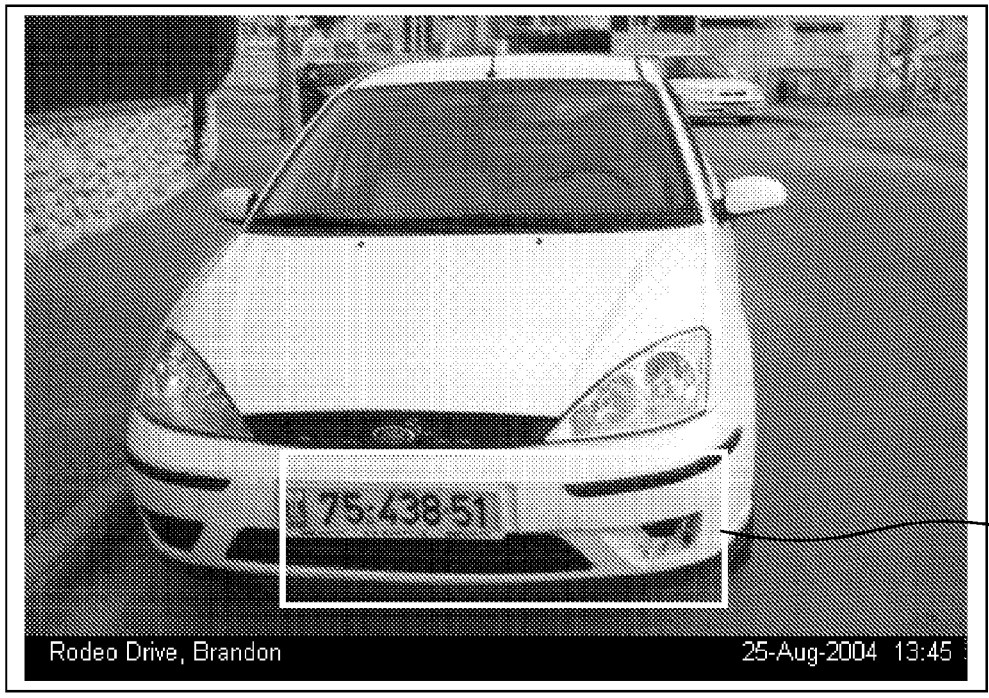
FIG. 5 illustrates an image of a parking vehicle to be photographed, as seen through the display means of a digital camera, according to one embodiment of the invention.

According to one embodiment of the invention, this problem is solved by adjusting the frame such a way that the ID of a photographed vehicle is at a certain place of the picture, e.g. at the lower-middle side of the picture. According to one embodiment of the invention, the digital camera used for this purpose comprises a frame, inside which the inspector has to locate the ID of a photographed vehicle. FIG. 5 illustrates an image of a parking vehicle to be photographed, as seen through the display means of a digital camera, according to one embodiment of the invention. Frame 35, visible on the screen or by optical means of the digital camera, enables an inspector to locate the ID of a photographed vehicle in a certain place of the digital picture. The fact that the ID of a vehicle is expected to be at a particular location enables increasing the automation level of the process of identifying the ID of a parking vehicle and to speed up the OCR processing, and thereby the overall cost.

According to another embodiment of the invention, an operator verifies that the automatic system has identified the ID of a photographed vehicle, and in the event the system fails to do so, he can point to the place on the digital picture where the ID appears, move and adjust the size of a frame which comprises the ID, change the brightness, contrast and other characteristics of the image in order to provide a better image for processing, or even to type the ID.

The term Automatic ID Device (AID) refers herein to a device which is carried by a vehicle, and provides the ID of the vehicle or other identifying means associated with the vehicle to another device by communication means. An AID is referred to herein also as "transmitter".

The term Automatic ID Identifier (AII) refers herein to a device that communicates with an AID in order to get the ID of the vehicle thereof. An AII is referred to herein also as "receiver".

Figure 6:
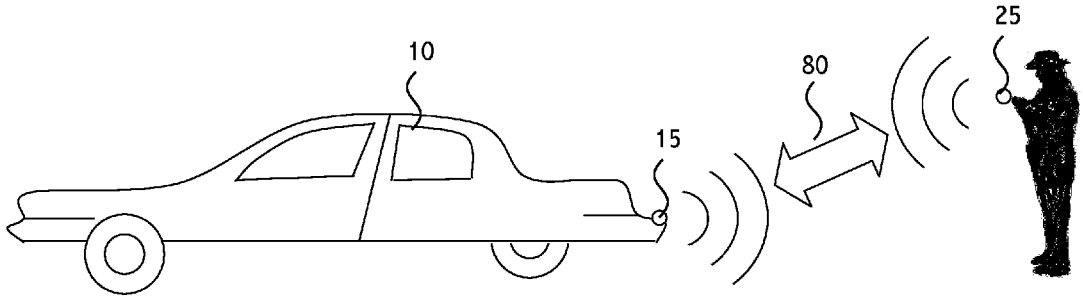
FIG. 6 schematically illustrates a system for detecting an ID of a vehicle, according to one embodiment of the invention.

FIG. 6 schematically illustrates a system for identifying a vehicle, according to one embodiment of the invention. The parking vehicle 10 is coupled with a Bluetooth device 15 (an AID, "transmitter"), which communicates with Bluetooth device 25 (an AII, "receiver") which is carried by a parking inspector. The system may comprise an indicator (e.g. LED, sound) for indicating that the ID of the vehicle has been received. Additionally or alternatively, the ID of the identified vehicle may be displayed on a display carried by the inspector. In order to prevent forgery of AID devices, the communication between an AID and an AII may be encrypted.

According to one embodiment of the invention, on the inspector's side the apparatus 25 may comprise a display for verifying the information transmitted by the vehicle, input means for adding text to the registered information, a LED for indicating that the vehicle has a Bluetooth ID transmitter, and so forth. Of course, a parking authority (e.g. municipality) may encourage utilization of a Bluetooth ID transmitter by providing lower parking rates for cars employing such a device, etc.

In case the vehicle lacks such a device, the parking inspector can photograph the parked vehicle, and process as in the optical recognition methods described above.

Other communication means that can be employed for communicating between an AID device and an AII are infrared (e.g. according to the IrDA protocol), radio (including Bluetooth), proximity cards, and so forth.

Comments

It should be noted that a video camera and other input devices can also be employed as a source for digital pictures.

It should also be noted that a variety of charging policies may be employed, such as a reduced rate or even free parking at certain hours of the day, a reduced rate or free parking if the vehicle parks near the residence of the owner thereof, etc. According to one embodiment of the invention, the owner of a vehicle buys a reduced rate by paying a fee. For example, an owner of a vehicle prefers to pay a fee in order to gain a reduced charge for parking the vehicle near his house, business, etc. According to one embodiment of the invention, a vehicle owner authorizing a parking authority to charge his account is granted a reduced parking rate.

Figure 7:
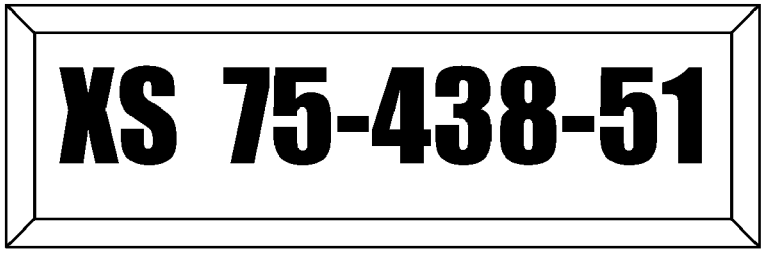
FIG. 7 schematically illustrates an ID number plate, according to one embodiment of the invention.
Figure 8:
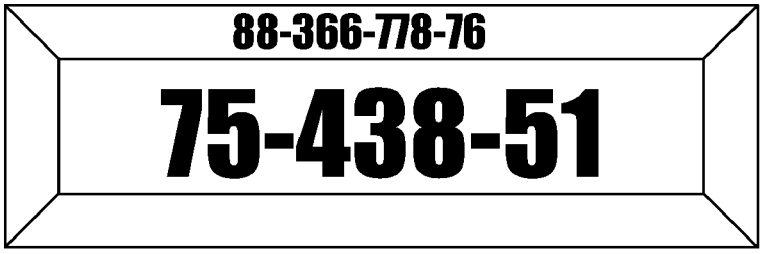
FIG. 8 schematically illustrates an ID number plate, according to another embodiment of the invention.

According to one embodiment of the invention, an identification code for the parking arrangement can also be used. FIG. 7 schematically illustrates an ID number plate, according to one embodiment of the invention. The letters "XS" denote a parking arrangement. FIG. 8 schematically illustrates an ID number plate, according to another embodiment of the invention. The text "88-366-778-76" denotes a parking arrangement for the vehicle thereof.

It should be noted that a variety of charging means and methods may be employed for charging a vehicle for parking, for example, a debit note sent to the users once in a while, adding the charges to the monthly municipal taxes, etc.

Figure 9:
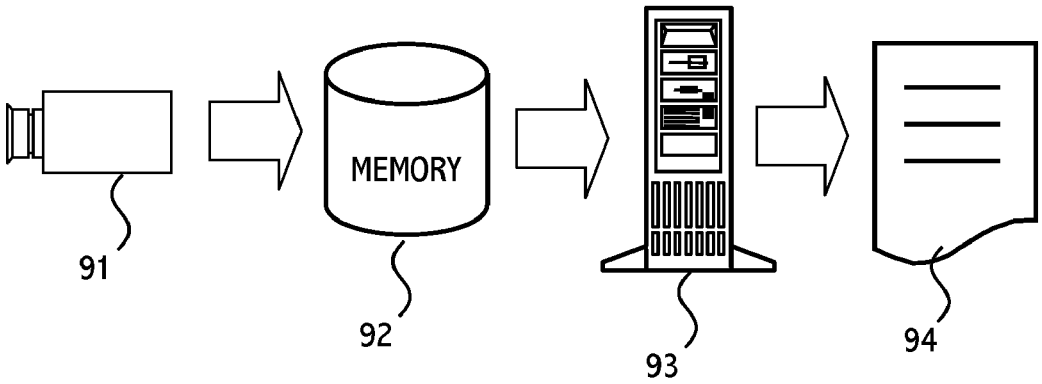
FIG. 9 schematically illustrates a system for charging a vehicle for parking, according to one embodiment of the invention.

FIG. 9 schematically illustrates a system for charging a vehicle for parking, according to one embodiment of the invention. The system comprises the following components:

- An input mechanism 91, for identifying a parked vehicle;
- A memory 92, for storing "parking transactions", i.e. information of parking vehicles, such as the ID of the vehicle, the place and time where the vehicle has been inspected as parked, etc.
- A charge calculator 93, for calculating a charge from the parking transactions stored within the memory 92; and
- A clearance mechanism 94, for charging and collecting payments for the parking transactions.

According to one embodiment of the invention, the input sub-system comprises a digital camera or video camera, for inputting a digital image of a parking vehicle. According to one embodiment of the invention, the camera is capable of impressing details such as time and place where a picture has been taken. Some of the details may be obtained automatically, e.g. date and time. Some of the details may be inputted by a parking inspector by keyboarding. Some of the details may be selected from a group of details, e.g. instead of typing the name of the parking zone, a parking inspector selects the name of a parking zone from a predefined list thereof.

According to another embodiment of the invention, the input means is a receiver that communicates with a transmitter of a vehicle by communication means, e.g. radio (such as Bluetooth), infrared (such as IrDA), proximity cards, and so forth.

The clearance mechanism may comprise a system for sending debit notes to the charged vehicles, keeping track of their payments, etc. According to one embodiment of the invention, the charges are automatically collected by a municipality (government authority, etc.) along with taxes.

Those skilled in the art will appreciate that the invention can be embodied in other ways and means, all within the scope of the invention. The embodiments described herein should be considered as illustrative and not restrictive.

The invention claimed is:

1. A method for charging vehicles for utilizing parking rights in a parking zone, the method comprising the steps of:

during a time period, intermittently collecting information of utilizing parking rights by vehicles parking in said parking zone, said collecting is carried out by an input apparatus;

identifying vehicles from the collected information by an identification apparatus;

for each vehicle of the identified vehicles, at the end of said time period calculating a toll for said utilizing parking rights by said vehicle; and charging said vehicle by said toll;

wherein said toll is calculated by dividing said time period into time intervals, each of one Parking Time Unit, and the beginning of the first of said time intervals starts at a fixed time.

2. A method according to claim 1, wherein said information comprises an identifier associated with said vehicle, and the time said collecting is carried out.

3. A method according to claim 1, wherein said collecting information of utilizing parking rights comprises:

photographing by said input apparatus a digital image of a vehicle;

decoding an identifier of said vehicle from said digital image by OCR means; and optionally, adding additional information related to said utilizing parking rights.

4. A method according to claim 1, wherein said collecting information of utilizing parking rights is carried out by:

transmitting by an apparatus of said vehicle an identifier of said vehicle to said input apparatus; and optionally, adding additional information by a parking inspector.

5. A method according to claim 1, wherein said parking zone is selected from the group consisting of: a city, a street, and a parking yard.

6. A method according to claim 1, wherein said time period is selected from the group consisting of: at least one day, at least one week, at least one month.

7. A method according to claim 1, wherein said calculating a toll is further based on a parking arrangement of said vehicle in said parking zone.

8. A method according to claim 7, wherein said parking arrangement is selected from a group consisting of: a special rate for a vehicle of an habitant of said parking zone, a special rate for a vehicle parking during certain hours of a day, a special rate for a vehicle that its owner pays a fee for utilizing parking rights in said parking zone.

9. A system for charging vehicles for utilizing parking rights in a parking zone, the system comprising:

an input apparatus, for intermittently gathering information associated with a vehicle parking in a parking zone during a time period;

means for identifying said vehicle from said information; a charge calculator, for calculating a toll from said information at the end of said time period; and a clearance mechanism, for charging said vehicle by said toll;

wherein said toll is calculated by dividing said time period into time intervals, each of one Parking Time Unit, and the beginning of the first of said time intervals starts at a fixed time.

10. A system according to claim 9, wherein said input apparatus is selected from the group consisting of: a digital camera, a video camera, a receiver communicating with a transmitter carried by a vehicle and transmitting an identifier associated with said vehicle.

11. A system according to claim 10, wherein said input apparatus further comprises input means, for inputting information by a parking inspector.

12. A system according to claim 9, wherein said information is stored in a memory until said toll is calculated, said memory is selected from the group consisting of: a database, a file, non-volatile memory, and flash memory.

13. A system according to claim 11, wherein said information comprises the place where said utilizing parking rights has been carried out.

14. A system according to claim 9, wherein said charge calculator is adapted to calculate a charge in accordance with a parking arrangement thereof.

15. A system according to claim 9, wherein said clearance mechanism comprises a database of vehicles and associated owners.

16. A system according to claim 9, wherein said input apparatus is adapted to be portable.

* * * * *